United States Patent [19]

Rundo

[11] Patent Number: 4,545,549

[45] Date of Patent: Oct. 8, 1985

[54] TAPE WINDING APPARATUS

[75] Inventor: John R. Rundo, Strongsville, Ohio

[73] Assignee: The B. F. Goodrich Company, Akron, Ohio

[21] Appl. No.: 614,080

[22] Filed: May 24, 1984

Related U.S. Application Data

[62] Division of Ser. No. 410,293, Aug. 23, 1982, Pat. No. 4,477,036.

[51] Int. Cl.[4] ..... B65H 23/16; B65H 57/28

[52] U.S. Cl. ..... 242/158.4 R; 242/DIG. 2; 242/67.5; 242/75.3; 242/158 B

[58] Field of Search ..... 242/DIG. 2, 67.5, 75.3, 242/158 B, 67.3 R, 158.4 R; 156/429, 446

[56] References Cited

U.S. PATENT DOCUMENTS

| | | | |
|---|---|---|---|
| 2,226,961 | 12/1940 | Arnold | 242/DIG. 2 |
| 3,370,808 | 2/1968 | Cox et al. | 242/158.4 R |
| 3,401,073 | 9/1968 | Wood | 156/446 X |
| 3,456,898 | 7/1969 | Anderson et al. | 242/158.4 R |
| 3,518,889 | 7/1970 | McClean | 242/158 B X |
| 4,352,467 | 10/1982 | Dunn et al. | 242/67.3 R X |
| 4,413,792 | 11/1983 | O'Conner | 242/DIG. 2 X |

FOREIGN PATENT DOCUMENTS

| | | | |
|---|---|---|---|
| 654026 | 12/1962 | Canada | 242/75.3 |

*Primary Examiner*—Stuart S. Levy
*Assistant Examiner*—Katherine Jaekel
*Attorney, Agent, or Firm*—Joseph Januszkiewicz

[57] ABSTRACT

The winding of a tacky sealant strip by applying a non-sticking liner into contact with one surface of the strip such that the liner provides marginal edges on either side of the sealant strip. The strip and liner are wound progressively into a reel such that the liner maintains a clearance space between adjacent sealant strips while simultaneously providing a non-sticking circumferential surface for a second wound row of sealant strip material. Additional rows of such liner and strip are progressively wound on such reel.

1 Claim, 9 Drawing Figures

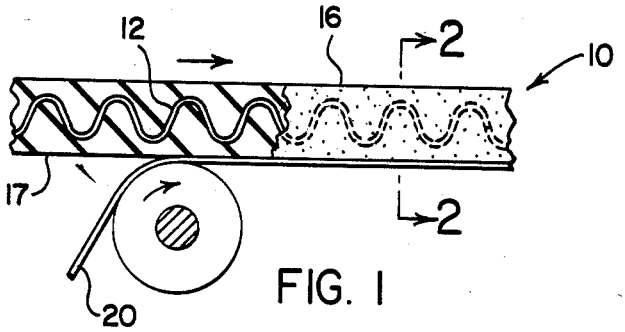
FIG. 1
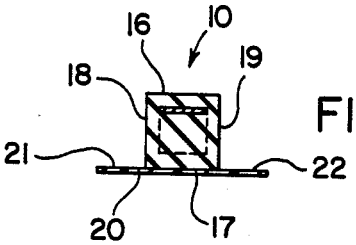
FIG. 2
FIG. 3
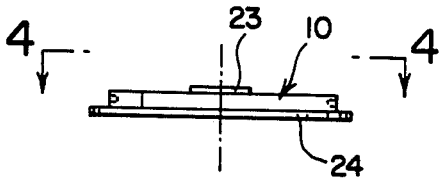
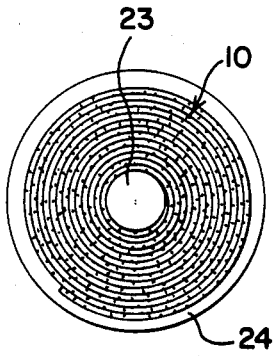
FIG. 4

TAPE WINDING APPARATUS

This is a division of application Ser. No. 410,293, filed Aug. 23, 1982, now U.S. Pat. No. 4,477,036.

BACKGROUND OF THE INVENTION

This invention relates to a method and an apparatus for winding mastic adhesive or sealant tape onto a reel such that the reel has several layers wound thereon.

The mastic tape is a deformable sealant strip that may include a rigid undulating spacer therein, which spacer is first formed into an undulating shape and then advanced into a crosshead die where the undulating spacer is embedded or encapsulated with a mastic containing an adhesive. The spacer and mastic is extruded as a continuous sealant strip having a quadrilateral cross-sectional shape. To facilitate the winding up of the strip a non-sticking liner is applied to one continuous running length of the sealant strip such that it may be wound into a flat circular plate whose axis during rotation and winding is in a vertical plane. A cover is then placed over it and thence placed into a drum for storage along with successive subsequent and similar flat plates of the sealant. The present invention provides a new and improved method and apparatus for winding and storing mastic tape or sealants which may be any butyl extrudate, a formed sealant strip that is deformable or a deformable sealant strip having a rigid undulating spacer. The strip or sealant is wound onto a reel that has its axis of rotation in a horizontal plane whereby numerous layers of the strip are wound in overlapping relationship onto one roll rather than merely one layer onto a single circular member, thereby reducing the labor cost and increasing the ability to apply the strip material in subsequent operations utilizing long uninterrupted applications.

SUMMARY OF THE INVENTION

The present invention contemplates an apparatus and method for winding a deformable sticky sealant strip that may include a rigid undulating spacer therein by first moving the strip past a roller that feeds a non-sticking liner into contact with one running surface thereof. The sticky sealant strip with liner is then fed onto a rotating reel such that the sticky side of the sealant strip which is opposite the side covered by the liner contacts the reel core as it is wound thereon. The liner acts as a spacer for the adjacent wound sealant as one row of sealant is wound around the reel and also acts as a liner upon which another layer of sealant strip is wound.

BRIEF DESCRIPTION OF THE DRAWINGS

FIG. 1 is a side elevational view of a sealant strip, with a portion of the mastic material removed to disclose a corrugated spacer, having a carrier liner being placed on the underneath portion thereof.

FIG. 2 is a cross-sectional view of the sealant strip and liner taken on line 2—2 of FIG. 1.

FIG. 3 is a side elevational view of a wound-up sealant strip on a circular packing member.

FIG. 4 is a plan view of a wound-up sealant strip on a packing member.

DETAILED DESCRIPTION

Figure 5:
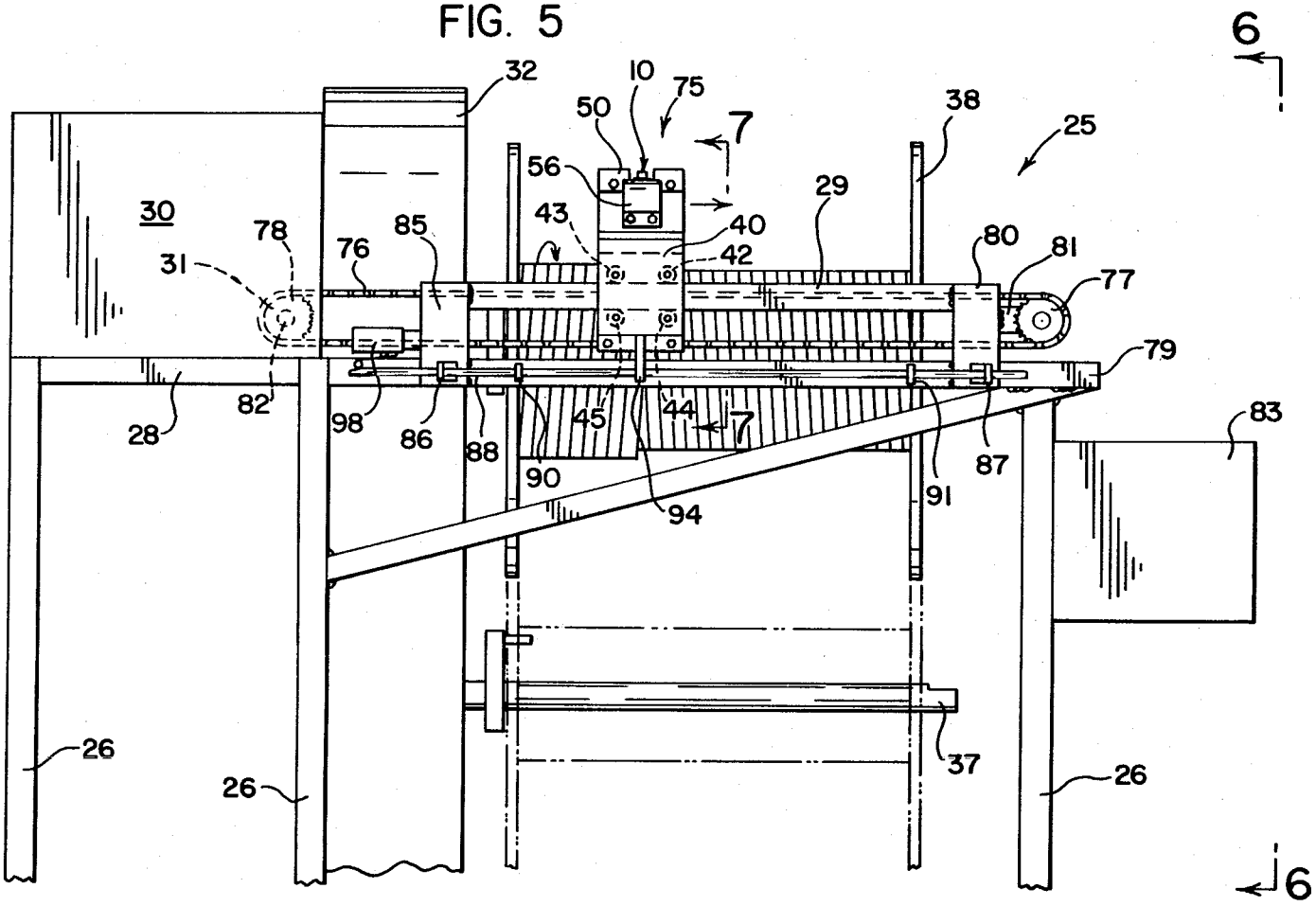
FIG. 5 is a rear elevational view of the apparatus.

Referring to the drawings, wherein like reference numerals designate like or corresponding parts throughout the several views, there is shown in FIG. 1 a sealant strip 10 made of a deformable mastic or sealant fully enveloping or encapsulating a spacer or spacer means 12, which spacer 12 extends longitudinally of the strip 10. The spacer means 12 is in the form of an undulating ribbon of rigid material such as aluminum. As seen in FIG. 2, the deformable sealant material that encompasses the spacer 12 is in intimate contact with all of the surfaces and edges of the spacer means 12. The sealant strip 10, as disclosed in FIG. 2 has an upper surface 16 and a lower surface 17 with parallel side surfaces 18 and 19.

The geometry of the spacer means 12 of sealant strip 10 presents a sine curve configuration with side edges closely adjacent the side surfaces 18 and 19 of the strip 10. With such geometry of spacer means 12, it is capable of resisting compressive forces exerted on it in a plane which is normal to the side edges of the sealant strip 10. The spacer means 12 would not be able to resist compressive forces on its surfaces 16 and 17 to any substantial extent but would on the side surfaces 18 and 19.

In making the sealant strip 10 a strip or spacer 12 is fed to a suitable mechanism which corrugates the spacer 12. The corrugated spacer 12 is then fed into the cross head of an extruder which encapsulates the spacer 12. The term sealant strip as used herein also includes strips of extrudate or formed sealant strips that exclude the use of spacer 12 as this is but one example of a sealant strip that is difficult to package.

As the sealant strip with the spacer therein exits from the extruder a non-sticking continuous strip of treated paper or protective liner 20 is fed into abutting contact with the lower surface 17 because the mastic material has a very tacky property and such liner facilitates the handling of such strip. For purposes of clarity, the spacer 12 and liner 20 are shown in a larger scale in the sealant strip 10 of FIG. 1. As shown in FIG. 2, the liner 20 is of greater width than the sealant strip 10 such as to provide marginal edge portions 21 and 22 on either side of the sealant strip. The conventional way to package such strip 10 for shipping and storage is to place a liner on one side of the strip and then wind such strip 10 around a core 23 that is vertically disposed on a horizontal circular plate 24 (FIG. 3 and 4).

Figure 6:
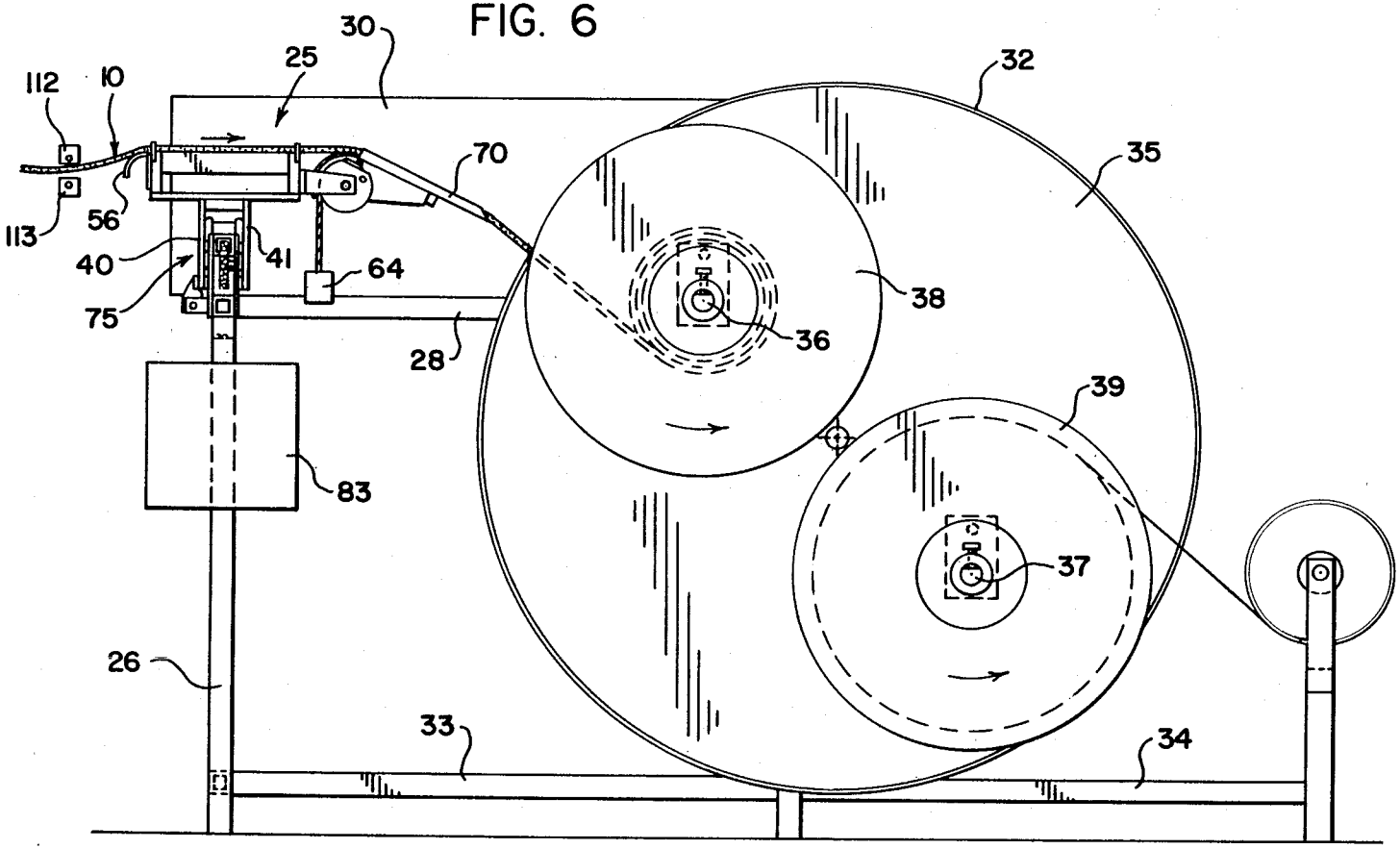
FIG. 6 is a side elevational view of the tape transfer carrier taken along lines 6—6 of FIG. 5.

In the improved method and apparatus, the sealant strip 10 and liner 20 is directed as a tape to a tape transfer means 25 which includes a support means having a plurality of upwardly extending supports 26 and a horizontally disposed base member 28 with a tubular frame member or guide rail 29. Base member 28 supports a housing 30 which houses the motor and transmission means including a drive sprocket gear 31. A second housing 32 is suitably mounted on frame work adjacent to the housing 30 and supports 26 as well as cross-braces 33, 34. Housing 32 has an indexable reel 35 on which is mounted a pair of shafts 36 and 37 which in turn support rotatable reels 38 and 39. When indexable reel 35 is indexed to the position shown in FIG. 6, shaft 36 and reel 38 are in a position to be rotated by a motor not shown within housing 30 through a suitable transmission means not shown but well known in the art.

Figure 7:
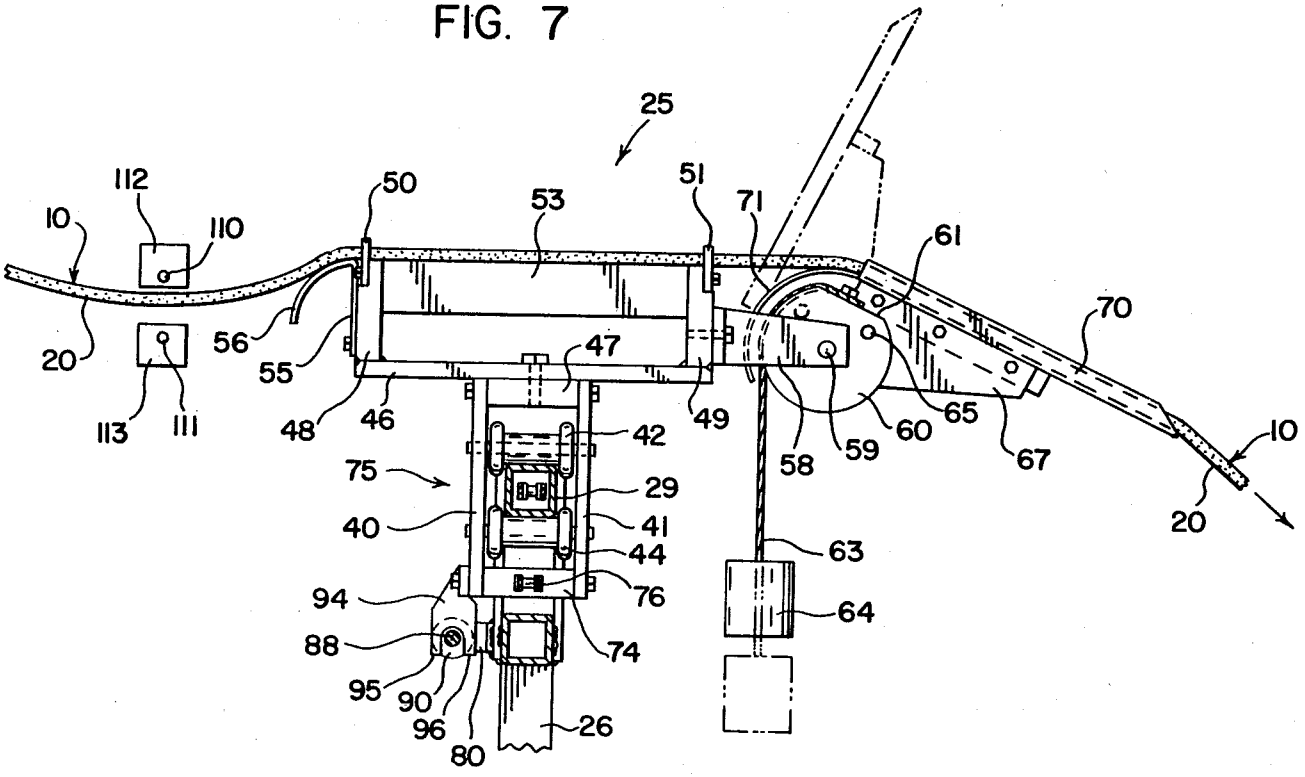
FIG. 7 is an enlarged side elevational view of a portion of the apparatus taken along line 7—7 of FIG. 5.

The tape transfer means for the sealant strip includes a pair of vertically spaced brackets 40 and 41 (FIGS. 5 and 7) having journaled thereon a pair of upper rollers 42 and 43 and a pair of lower rollers 44 and 45, which rollers engage the tubular guide rail 29 therebetween. The rollers 42 through 44 are flanged to captively secure the brackets and the associated parts therewith for lateral movement on the guide rail 29.

A horizontally disposed plate member 46 with a spacer 47 is suitably secured to the spaced brackets 40 and 41. A pair of spaced end plates 48 and 49 are secured to the plate member 46. The end plates 48 and 49 (FIGS. 5 and 7) have U-shaped guide brackets 50 and 51 respectively to guide the liner 20 and sealant strip 10 toward a windup reel to be described. An inverted U-shaped member 53 is secured to the brackets 50 and 51 to cooperate with the brackets 50 and 51 to guide the liner 20 and sealant strip 10 therethrough. A plate 55 is secured to plate 48. Plate 55 has an arcuately shaped portion 56 which functions as a guide as the tape (liner 20 and sealant strip 10) is advanced through the guide brackets 50 and 51. A pair of spaced brackets 58 have their one ends secured to end plate 49. Journaled for rotation on brackets 58 about axle 59 is a circular member 60 that has an upper flat portion 61 to which is attached a cable 63. Cable 63 extends along a groove in the rear portion of the periphery of circular member 60 and thence downwardly for attachment to a counterweight 64 for counterbalancing purposes. The amount of weight attached to such cable 63 is sufficient to provide a tension on the sealant strip and liner as it passes from the extruder to the windup reel 38. A pin 65 attached to the forwardly disposed side portion of circular member 60 as viewed in FIG. 7 operates as a stop to limit the rotation of member 60 about shaft 59. Pin 65 is adapted to strike the bracket 58 upon counter-clockwise rotation of member 60. A triangular shaped bracket 67 is suitably attached to the circular member 60 for rotation therewith. A U-shaped guide member or chute 70 is attached to bracket 67 for directing the tape (liner 20 and sealant strip 10) from the guide bracket 51 to the reel 35 for windup. An arcuate plate 71 has one end secured to the one end of chute 70 and generally follows the peripheral contour of the circular member 60.

A cross brace 74 is connected between and cooperative with the vertically spaced brackets 40 and 41 to define a carriage 75, which carriage 75 is adapted to reciprocate on guide rail 29. A chain sprocket 76 connected to cross brace 74 is trained about a sprocket 77 and thence back over sprocket 78 for connection to carriage 75. Thus rotation of sprocket 78 determines the direction of linear movement of carriage 75 on guide rail 29. A horizontally disposed bracket 79, connected to base member 28 and supports 26, has a vertically extending plate 80 connected adjacent one end thereof. Sprocket 77 journaled on bracket 81 is mounted on plate 80 while sprocket 78 is suitably mounted on a drive shaft 82 that is journaled in housing 30 and suitably connected to a variable speed motor that controls the speed of rotation of drive sprocket 78 via a control box 83. Those skilled in the art may readily provide suitable controls for regulating the speed of sprocket 78.

A plate member 85 is mounted on the bracket 79 in alignment with plate 80. The respective laterally spaced plates 85 and 80 have angle brackets 86 and 87 with aligned bores to receive a rod 88 that is linearly moveable therethrough and therebetween. A pair of adjustable stops 90 and 91 are mounted on rod 88 to limit the axial movement of such rod. Carriage 75 (FIG. 7) has a depending bracket 94 with a pair of depending leg portions 95-96 straddling rod 88. There is sufficient clearance between the rod 88 and leg portions 95-96 to assure the operator that bracket 94 does not frictionally engage or contact rod 88. As carriage 75 moves in a rightward direction as viewed in FIG. 5, bracket 94 is carried along with it until bracket 94 along with leg portions 95 and 96 engage stop 91 to thereby move stop 91 in a rightward direction along with rod 88. As rod 88 is displaced rightwardly (as viewed in FIG. 5) the left end portion of rod 88 allows a spring biased lever on switch 98 to fall and reverse the rotation of the motor connected to drive sprocket 78 thereby reversing the direction of movement of carriage 75. As carriage 75 reverses its direction of movement bracket 74 will come in contact with stop 90 to move such stop 90 and rod 88 in a leftward direction until rod 88 engages and raises the spring bias of switch 98 to again reverse the direction of rotation of drive sprocket 78. The stops 90 and 91 thus control the reciprocal movement of carriage 75.

As the tape is discharged from the chute 70, the tape is directed in a downwardly direction such that the sealant strip 10 comes into contact with the hub 100 of the flanged reel 38. As the reel 38 is rotated the liner 20 is located along the outer periphery of the sealant. Reel 38 is continued in its rotation as the carriage 75 is slowly moved linearly thereby winding the tape (sealant 10 and liner 20) axially along the hub 100 of reel 38. The reel 38 has a bore 101 along its one circular flange portion to receive a pin 102 that is attached to a disc 103 which in turn is suitably secured to shaft 36. Rotation of shaft 36 thereby rotates the reel 38. The outer circular flange portion of reel 38 has a sleeve 105 integral therewith. A bolt 106 threaded through a threaded bore in sleeve 105 is adapted to frictionally engage a recessed portion on shaft 36 to securely connect such reel to shaft 36 to prevent lateral movement thereon.

Figure 8:
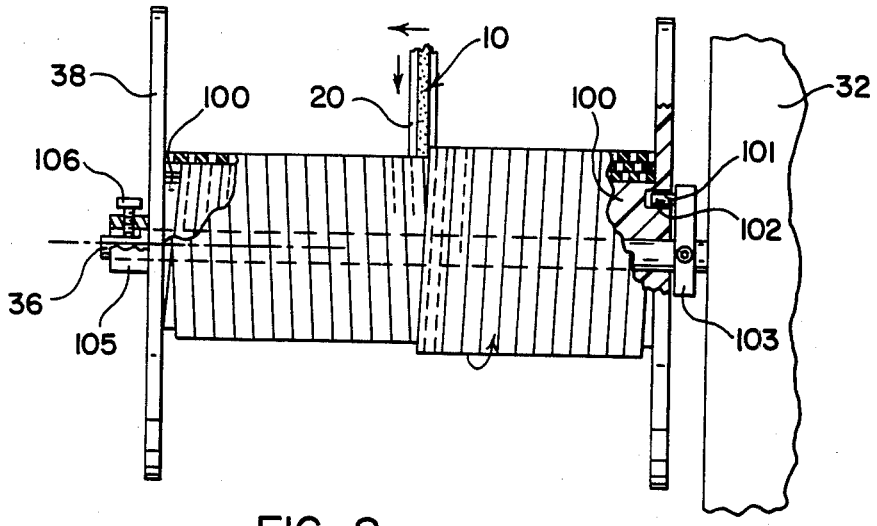
FIG. 8 is a front elevational view of the reel support.
Figure 9:
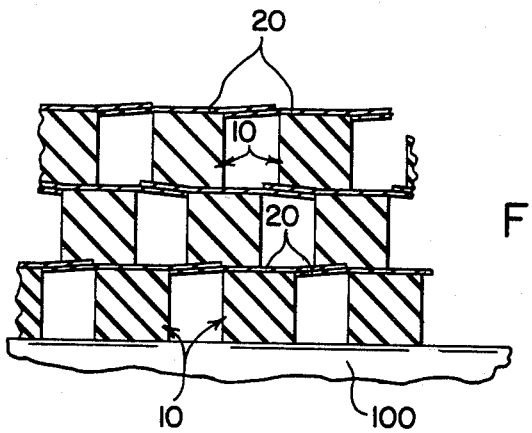
FIG. 9 is a fragmentary front view of a portion of the hub with sealant strip and liner wound onto such hub showing the spacing between the sealant strips.

The tape (sealant 10 and liner 20) is wrapped axially across the hub 100 of reel 38 with the respective marginal edges of the liner overlapping adjacent liner margins in an axial direction. As the tape is completely wound across the hub, the direction of axial movement of carriage 75 is reversed and a second row of tape is wound on the first axial layer of tape such that the surface 16 of the sealant strip which is opposite the liner 20 comes into contact and abutting relationship with the liner 20 of the first layer of tape. In this winding of the second layer of tape the marginal edges of adjacent tapes overlap each other to provide a clearance space between adjacent side surfaces of adjacent sealant strips. The winding of such tape is continued until sufficient rows of tape are wound on reel 38. As seen in FIG. 8 the respective rows as being wound onto reel 38 have a taper in opposite directions which assure support for succeeding rows of tape. As seen in FIG. 9, this type of winding staggers the vertical alignment of the sealant strips to assure full support. As the additional strips of tape are wound onto reel 38 the reel's speed of rotation is decreased incrementally since the speed of the extrusion rate is substantially constant. Such decrease in speed is old and well known in the art and in the described embodiment can be tied to the reversal of the motor that rotates drive sprocket 78. To provide an additional input to control the speed of such rotation of reel 38, a pair of vertically spaced motor control levers 110 and 111 are located between the discharge from an extruder and carriage 75 to assure sufficient slack in the feed of the tape to eliminate any possible tensioning of the tape. Levers 110 and 111 are pivotally mounted to sensor units 112 and 113 respectively such that as the sealant strip and liner 20 begins to fall to a low level, the liner 20 will contact lever 111 and sensor 113 which signals the motor control for the reel 38 to increase the speed of rotation whereas if the sealant strip 10 contacts lever 112, then sensor 112 is actuated to decrease the speed of rotation of reel 38. In lieu of dual sensors 112 and 113, a single control unit may be used which contacts the tape which in turn controls the speed of rotation of the reel 38. Such control unit would have a pivotal roller that rests against the upper surface of the tape at the same location as lever 110 and sensor 112. If the strip of tape begins to fall to a lower level, such control unit would allow an increase in the electrical current being supplied to the motor to control reel 38 thereby increasing its speed. Thus the strip of tape being festooned between the supply source such as the extruder and the carriage 75 will control such speed of reel 38. Where the tape tends to move upwardly from the position shown in FIG. 7, the speed control unit would decrease the amount of electrical current being supplied to the motor that controls the speed of the reel and thus permit the untensioned movement of the tape.

Thus the speed control unit will tend to match the speed of rotation of reel 38 to prevent stretching or other deformation of the strip of tape or sealant or any undue amount of festooning between the carriage 75 and the extruder. See U.S. Pat. Nos. 3,250,244 and 1,801,374 showing these controls to be old and well known in the art.

Various modifications are contemplated and may obviously be resorted to by those skilled in the art without departing from the described invention, as hereinafter defined by the appended claims, as only a preferred embodiment thereof has been disclosed.

I claim:

1. An apparatus for winding a tacky sealant strip comprising support means, a guide rail mounted on said support means, a carriage mounted on said guide rail for reciprocal movement thereon, a drive means connected to said carriage for reciprocating said carriage on said rail, a tape guide member mounted on said carriage for directing sealant tape therethrough as said carriage traverses said guide rail, said tape guide member having a forwardly disposed end for receiving sealant tape and a discharge end for discharging sealant tape, a reel journaled on said support means operative to receive a tape for windup thereon from said tape guide member, drive means connected to said reel for rotating said reel to windup tape thereon, and said tape guide member including a tension control means, a slide bar is mounted on said support means, said slide bar having a pair of axially spaced stops, switch means mounted adjacent one end of said slide bar for selective contact therewith for controlling the direction of movement of said carriage, said carriage having a bifurcated plate moveable therewith and along the length of said slide bar and operative to selectively engage one or the other of said spaced stops to cause said slide bar to move into engagement with said switch means to actuate said switch to control the direction of movement of said carriage, said tension control means includes a wheel mounted for rotation on said carriage, a chute mounted on said wheel for movement therewith, said chute mounted on said wheel in alignment with said tape guide member and operative to discharge tape outwardly away from said guide member, said chute being biased in a direction away from said reel to apply tension to tape moving from said chute to said reel, motor control means are interconnected between said switch means and said drive means to decrease the speed of rotation of said reel with each actuation of said switch means.

* * * * *